US005844186A

United States Patent [19]

Meriwether

[11] Patent Number: 5,844,186

[45] Date of Patent: Dec. 1, 1998

[54] MOTOR CONTRACTOR WITH MECHANICAL LOCK-OUT

[75] Inventor: James H. Meriwether, Milwaukee, Wis.

[73] Assignee: Allen Bradley Company, LLC, Milwaukee, Wis.

[21] Appl. No.: 701,603

[22] Filed: Aug. 22, 1996

[51] Int. Cl.[6] ..... H01H 9/20; H01H 9/28

[52] U.S. Cl. ..... 200/50.02; 200/43.11

[58] Field of Search ..... 200/43.11, 43.12, 200/43.14, 16 A, 5 R, 61.71, 61.74, 50.02, 50.29; 335/160, 132, 198, 167–176, 202, 205

[56] References Cited

U.S. PATENT DOCUMENTS 3,745,492 7/1973 Grunert ..... 335/167
5,164,695 11/1992 Monson et al. ..... 335/202

*Primary Examiner*—Wynn Wood Coggins
*Assistant Examiner*—Michael L. Hayes
*Attorney, Agent, or Firm*—Keith M. Baxter; John M. Miller; John J. Horn

[57] ABSTRACT

A contactor for use in controlling electrical motors may include a mechanical stop engaging the armature of the contactor and having an eyebar receiving one or more shackles of padlocks to prevent closure of the contactor contacts despite the application of an actuation current. An auxiliary switch may disconnect the coil of the contactor when the stop is positioned to lock the contactor providing additional resistance to actuation of the contactor 10.

8 Claims, 2 Drawing Sheets

MOTOR CONTRACTOR WITH MECHANICAL LOCK-OUT

FIELD OF THE INVENTION

The present invention relates to industrial contactors for controlling motors and the like, and in particular to a contactor having a mechanical lock-out to prevent accidental turning-on of the contactor.

BACKGROUND OF THE INVENTION

Large electrical motors may be controlled through a contactor which provides a set of high current electrical contacts that open or close in response to a low-current actuation signal. The actuation signal energizes a coil to produce a magnetic field that pulls in a ferromagnetic armature connected to the electrical contacts. Gravity or a return spring causes the armature to open the contacts when the actuating signal is no longer present.

Commercial contactors may be customized by adding additional banks of electrical contacts to a single armature. For this purpose, a portion of the armature (a crossbar) extends out of the housing of the contactor so that the additional contacts may be attached to the armature.

In a typical motor control application, three phase power from a power line is connected to a disconnecting means (a disconnect switch or a circuit breaker) which provides three contacts (one for each phase of power) that simultaneously open or close to disconnect or connect the three phase power to the contacts of a contactor. One side of the contacts are connected to the motor so that when the contactor is actuated, power may flow to the motor. A remote low-amperage switch provides the actuation current to the coil of the contactor and is used to turn on and off the motor during normal operation.

If it is necessary to work on the equipment attached to the motor, the motor must be positively locked-out for safety reasons. Normally this is accomplished by mechanically opening the disconnecting means after the motor has stopped and locking the disconnecting means in the open position with one or more padlocks assigned to each of the individuals who will be working on the equipment. Only when all the padlocks are removed can the disconnecting means be closed again.

Normally maintenance where the disconnecting means must be disconnected is infrequent. Therefore, although disconnect switches and circuit breakers are rated for high currents, they are normally only expected to operate for a few thousand operating cycles.

In certain industries, however, the disconnecting means may be cycled far more often. For example, in a sawmill, the saw blade must be replaced on a frequent and regular basis. Replacement of the saw blade is a situation where a positive lock-out of the driving motor is both warranted and required by applicable safety codes. In these situations, the disconnecting means may wear out quickly and have to be replaced frequently.

Contactors, in contrast to a disconnect switch or circuit breakers are designed to operate for millions of operating cycles but do not provide a positive lock out.

SUMMARY OF THE INVENTION

The present invention provides a contactor that permits positive mechanical lock-out and meets the requirements of an Energy Isolating Device as defined in OSHA rule 29 CFR §1910.147 hereby incorporated by reference. The contactor, which is rated in millions of operating cycles, may therefore be used to lock out a motor, instead of disconnecting means with its shorter operating life.

Specifically then, the present invention provides an electrical contactor having a coil with terminals to receive an activation current and an armature slideable within the coil to be drawn into the coil when the activation current is received by the terminals. At least one contact pair is attached to the armature to close with movement of the armature in the coil. A movable stop is provided having a first position blocking movement of the armature into the coil and a second position permitting movement of the armature into the coil. Finally, an eyebar is attached to the moveable stop with at least one eye passing a jamb with motion of the stop. The eye is sized to receive a shackle of a padlock. The jamb prevents motion of the eyebar and stop when a shackle is received in the eye of the eyebar.

Thus is it one object of the invention to provide an extremely durable positive mechanical lock-out for a motor that may serve as an alternative to cycling the disconnecting means. The contactor, which is normally open at the time the motor must be locked out, may be disabled by simple movement of a stop.

It is another object of the invention to provide a contactor with a positive mechanical lock-out that does not require extensive redesign of existing contactor components. The stop may coact with the portion of the armature of most contactors that is normally made accessible outside of the contactor for the ganging of additional contacts.

When the armature is in the coil, the stop is blocked from moving into the second position.

It is another object of the invention to prevent locking out of the contactor, and thus a false sense of security, if the contactor contacts are welded shut as a result of an earlier failure. If the armature has moved into the coil, as held by welded contacts, it blocks the stop and eyebar indicating to the user that lock out cannot be obtained.

The contactor may also include a sensing contact pair attached to the moveable stop when the moveable stop is in the locking position.

Thus it is another object of the invention to provide an electrical lock-out of the coil when the armature is mechanically locked out. Wiring the sensing contact pair in series with the coil terminals prevents the coil from being activated when the armature is locked out.

The electrical contactor may be enclosed in a cabinet having a door with an aperture. The eyebar may be positioned to extend through the aperture when the door is closed and the aperture may be sized so that the door is held closed by interference between the aperture and a shackle of a padlock when the shackle is received in the eye.

Thus it is another object of the invention to prevent tampering with the contactor when the contactor is locked out.

A flexible cable may connect the eyebar to the moveable stop.

Yet another object of the invention is to permit the eyebar, that must be accessible to a user wishing to lock the contactor out, to be flexibly located with respect to the remaining components of the contactor.

The moveable stop may include a first and second sliding plate, sliding with respect to one another when the stop moves between the locking and unlocking positions. The first plate may have mounting holes receiving screw fasteners attaching the first plate to a housing holding the coil armature and contact pair. The second plate may communicate with the eyebar and move therewith and have access holes aligning with the mounting holes in the first plate when the stop is in the second position but not when the stop is in the first position. The second plate may form the eyebar and the first plate may form the jamb.

Thus it is yet another object of the invention to provide a positive mechanical lock-out for a contactor that is simple and that may be readily retrofit to a contactor but that may not easily be defeated when the contactor is locked out.

The foregoing and other objects and advantages of the invention will appear from the following description. In this description, reference is made to the accompanying drawings which form a part hereof and in which there is shown by way of illustration, a preferred embodiment of the invention. Such embodiment does not necessarily represent the full scope of the invention, however, and reference must be made therefore to the claims for interpreting the scope of the invention.

DETAILED DESCRIPTION OF THE PREFERRED EMBODIMENT

Figure 1:
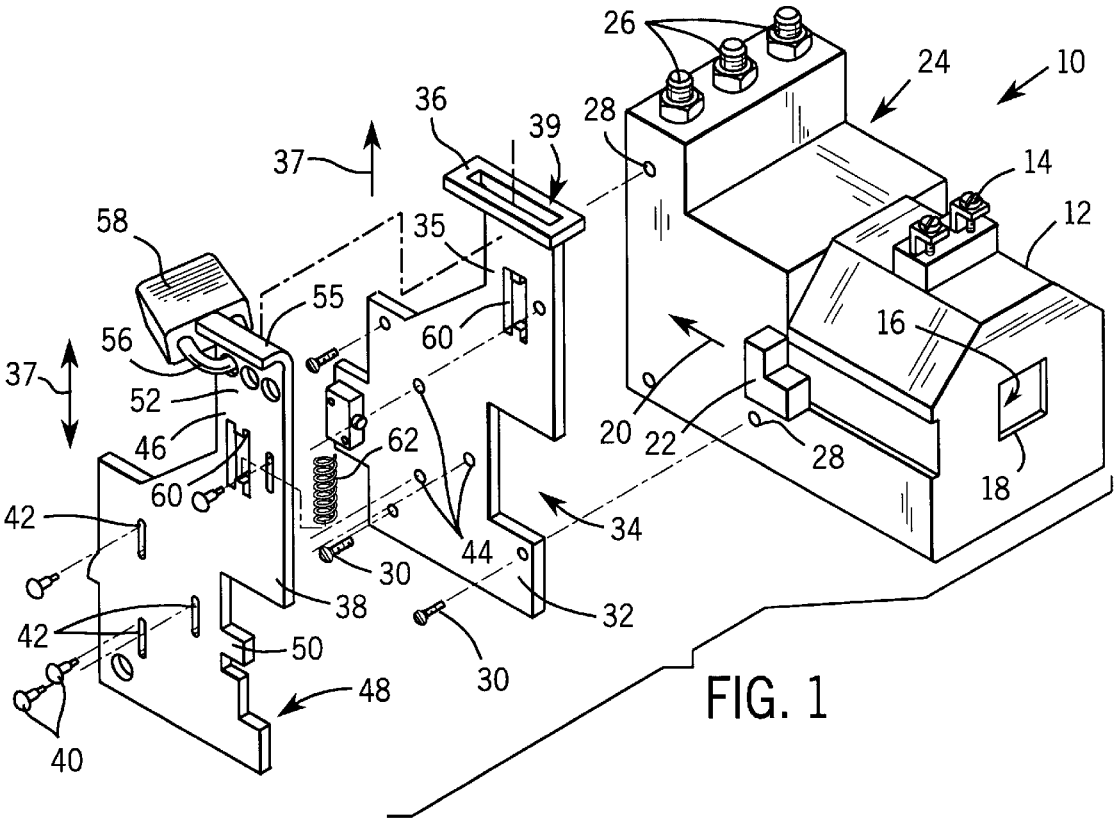
FIG. 1 is an exploded, perspective view of the present invention showing a typical contactor having a coil, a contact block and an exposed armature tab and showing a first plate attached to the housing of the contactor and providing a jamb and a second plate fitting against the first plate and providing a moveable stop to block the armature, the second plate having apertures for holding a shackle of a lock.

Referring now to FIG. 1, a contactor 10 includes a coil 12 incorporating a solenoid of electrical wire that may be energized with current through terminals 14 so as to create a magnetic field to pull an armature 16 into a bore 18 in actuation direction 20. The contactor 10 is normally mounted so that the actuation direction 20 faces upward and gravity serves to pull the armature 16 downward when the coil 12 is not actuated. For convenience in the description that follows "upward" will refer to the direction toward the top of the paper.

Attached to the armature 16 is a tab 22 which moves with the armature 16 and is present to permit additional contacts to be attached to the armature 16 in certain applications. The armature 16 communicates, inside a housing 24 of the contactor, and partially inside the coil 12, with a set of contacts (not shown) connected to terminals 26 for controlling current flow to a motor or the like.

Figure 2:
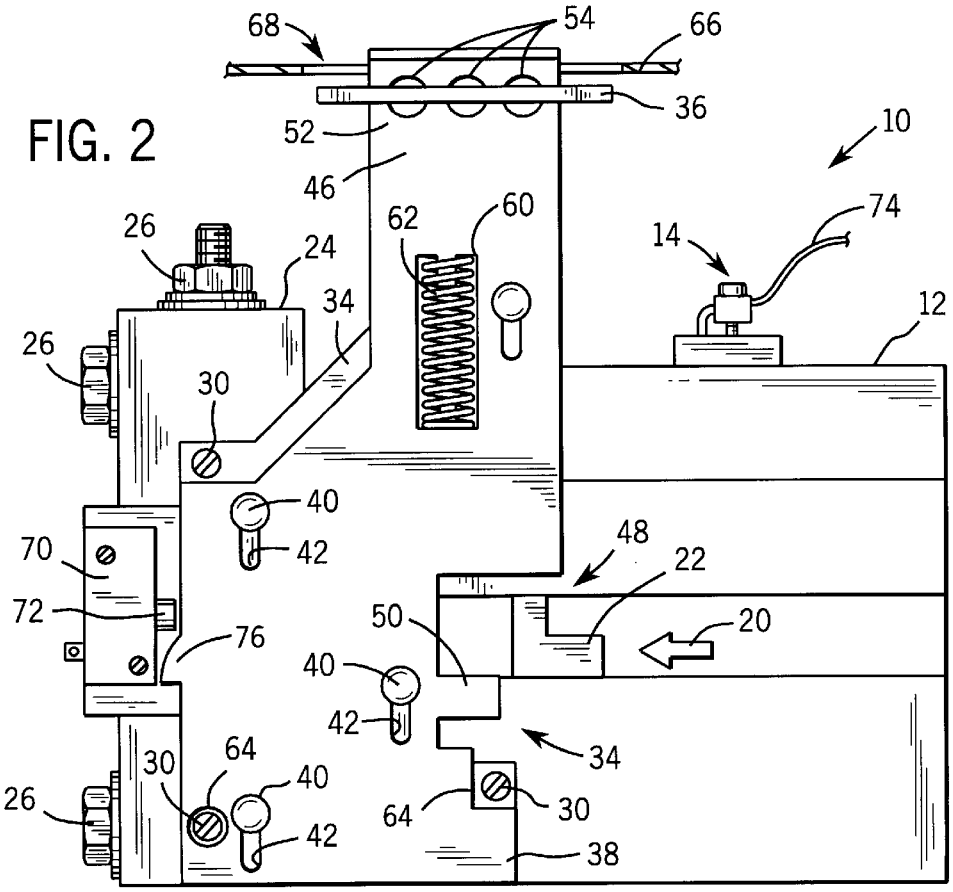
FIG. 2 is a front elevational view of the present invention in an unlocked state.
Figure 3:
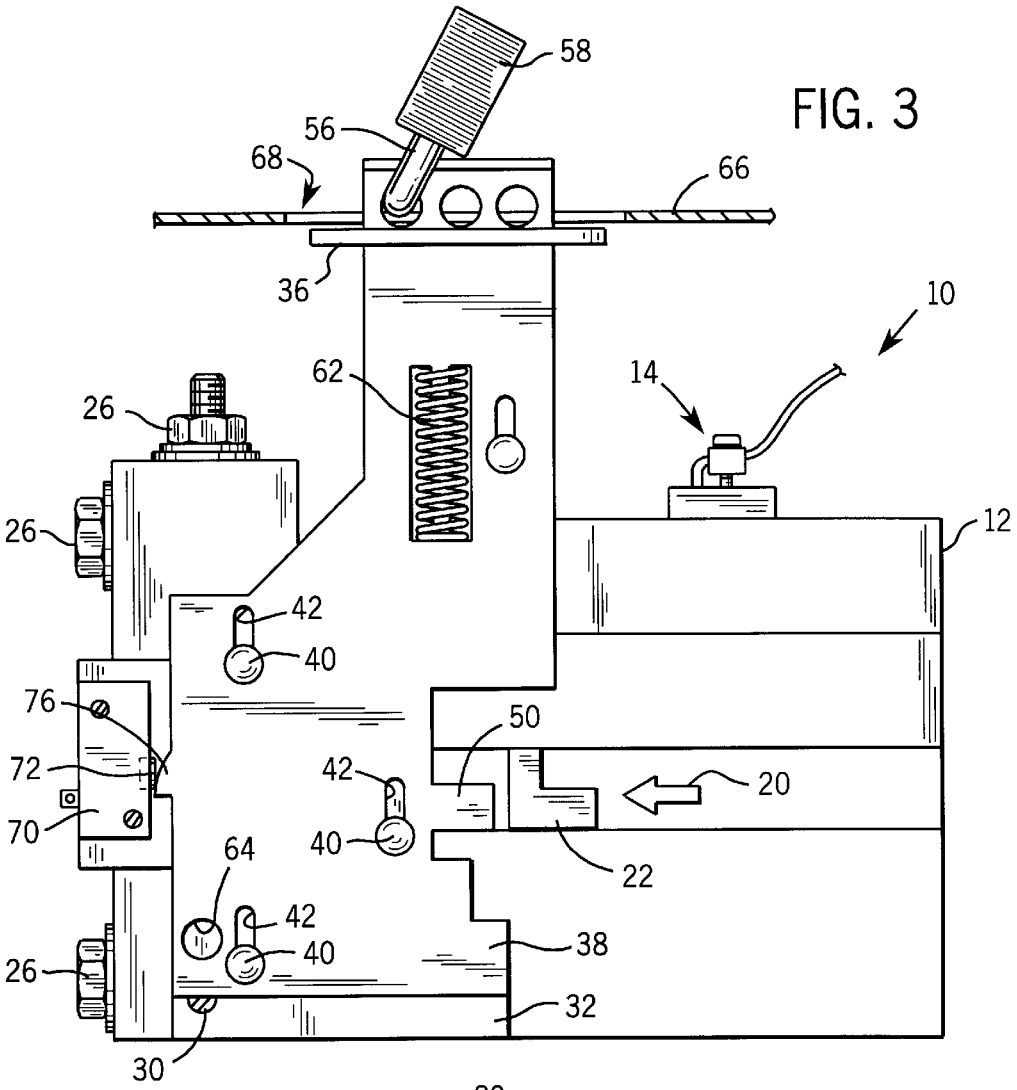
FIG. 3 is a figure similar to that of FIG. 2 showing the invention in the locked state with a padlock shackle inserted through the eyebar.

Normally, when the armature 16 is pulled fully in the actuation direction 20, the contacts close and current flows between upper terminals 26 visible in FIG. 1 and lower terminals 26 visible in FIGS. 2 and 3.

The housing 24 of the contactor 10 includes threaded holes 28 on the side from which the tab 22 extends which may receive machine screws 30. These threaded holes 28 normally are used to attach additional contact sets but, in the present invention, are used to mount (via the machine screws 30), a stationary plate 32 against the housing 24.

The stationary plate 32 includes a main body abutting the side of the contactor 10 and an extension portion 35 extending upward away from the contactor 10 along an actuation axis 37. The stationary plate 32 includes a notch 34 which fits around the tab 22 permitting the tab 22 to move back and forth with motion of the armature 16 during normal operation of the contactor 10. The uppermost end of the extension portion 35 of the stationary plate 32 is folded at approximately 90 degrees with respect to the remainder of the stationary plate 32 to provide a jamb 36 having a slot 39.

A sliding plate 38 having similar dimensions to stationary plate 32 attaches to the surface of stationary plate 32 sandwiching the stationary plate 32 between the sliding plate 38 and the wall of the contactor 10. The sliding plate 38 is attached to slide along the stationary plate 32 by means of shouldered rivets 40 passing through slotted holes 42 in the sliding plate 38 to be received by retaining holes 44 in the stationary plate 32. The slotted holes 42 are oriented to permit sliding of the sliding plate 38 along an actuation axis 37 as retained by the heads of the shouldered rivets 40.

An extension portion 46 of the sliding plate 38, similar to extension portion 35 of the stationary plate 32 passing upward and through the slot 39 of jamb 36. The upper part of the extension portion 46 provides an eyebar 52 having multiple eyes 54 through which a shackle 56 of a padlock 58 may be inserted as will be described. A flange 55 is formed in the topmost edge of the extension portion 35 to permit the extension portion 35 to be gripped and pulled outward.

The sliding plate 38 has a notch 48 that corresponds generally with the notch 34 in the stationary plate 32 but that includes a stop 50 extending outward from the bottom of the notch 34 so that, when the sliding plate 38 is fully in its upward position along actuation axis 37 (a locked position), the stop 50 prevents movement of the tab 22 in actuation direction 20, but that when the sliding plate 38 is fully in its downward position along actuation axis 37 (an unlocked position), permits unobstructed movement of the tab 22 in actuation direction 20.

Slots 60 are cut in each of stationary plate 32 and sliding plate 38 in the extension portions 35 and 46 to contain a spring 62 held between opposite walls of the slots 60 to bias the sliding plate 38 to a downward or unlocked position with respect to the stationary plate 32.

Referring now to FIG. 2, in the unlocked position, with sliding plate 38 biased downward with respect to stationary plate 32, the stop 50 is displaced to one side of tab 22 with respect to actuation direction 20 allowing the tab 22 free motion in actuation direction 20. The rivets 40 in this situation are resting against the topmost extent of their slots 42 and openings 64 in the sliding plate 38 align with the machine screws 30 providing ready access to the machine screws 30 for attaching or removing the stationary plate 32 from the contactor 10. In the unlocked position, the eyes 54 of the eyebar 52 of extension portion 46 are blocked by the jamb 36.

Referring now to FIG. 3, the eyebar 52 may be pulled upward by the flange 55 to free the eyes 54 from the obstruction of the jamb 36 so that the shackle 56 of the padlock 58 may be inserted through an eye 54 and locked. When the flange 55 is released the spring 62 serves to retract the eyebar 52 back toward the jamb 36 where further motion is stopped by interference between the jamb 36 and the shackle 56. Additional padlocks 58 may be inserted through each of the eyes 54. The sliding plate 38 in now in the locked position.

In this locked position the stop 50 abuts a face of the tab 22 preventing it from moving in the actuation direction 20 and thus physically preventing closure of the contacts of the contactor 10 regardless of an activation current into terminals 14 of the coil 12. In the locked position, the openings 64 no longer align with the machine screws 30 so the locking of the contactor 10 cannot be defeated by removing the stationary plate 32 and sliding plate 38 from the contactor 10.

Referring now to FIGS. 2 and 3, attached to the stationary plate 32 is a push button sensor switch 70 having an operator 72. A cam 76 is formed in one edge of sliding plate 38, extends outward toward switch 70. When the sliding plate 38 is in the unlocked position, as shown in FIG. 2, the cam 76 is free from the operator 72 of the switch 70 and the contacts of the switch 70 are closed. These contacts may be placed in series with the terminals 14 of the coil 12 by means of leads 74 so that actuation current may be conducted along lead 74 through the coil 12 to activate the contactor 10.

When the sliding plate 38 moves upward to the locked position, as shown in FIG. 3, the cam 76 depresses the operator 72 of the switch 70 opening internal contacts to the switch. When the switch 70 is wired in series with a terminal 14 of the coil, the contactor 10, when the sliding plate 38 is in the locked position, is not only physically prevented from closing its contacts but electrical actuation currents to the coil 12 are also blocked preventing unnecessary heating of the coil 12.

Figure 4:
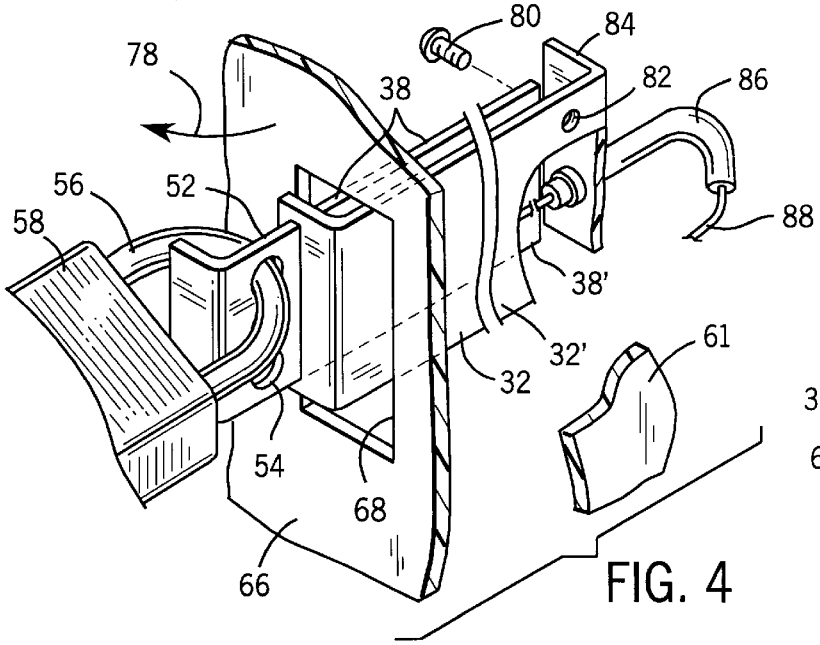
FIG. 4 is a fragmentary perspective view of the eyebar connected to a cable bracket of a second embodiment of the invention in which a flexible cable is used.

As shown in FIG. 4, normally the contactor 10 will be placed in a cabinet 61 having a door 66 opening as indicated by arrow 78. The door 66 includes an aperture 68 through which the eyebar 52 extends slightly when the sliding plate 38 is in the locked position and with which the jamb 36 is essentially flush. The aperture 68 is sized to be smaller than the padlock 58.

Referring now to FIGS. 3 and 4, when the sliding plate 38 is in the locked position, the eyebar 52 extends outward through the aperture 68 cut into the door 66 and the padlock 58 attached to an eye 54 is outside the cabinet 61 and the door 66. An opening of the door 66 is prevented, the padlock 58 is locked to an eye 54 by an interference between the shackle 56 or padlock 58, and the wall of the door 66 around aperture 68. Thus additional protection is provided against a defeating of the locking out of contactor 10 by preventing access to the contactor 10 and its wiring and typically to the wiring of the disconnect switch also contained within the cabinet with the contactor 10.

The extension portions 46 and 35 of sliding and stationary plates 38 and 32 may be broken to permit the eyebar 54 to be relocated to a position other than that dictated by the location of the contactor 10. In particular, a first half of the stationary plate 32' may be mounted to the cabinet 61 by means of fasteners 80 passing through mounting holes 82 in that first half. This first half of the stationary plate 32' may include a formed flange 84 attaching the outer sheathing of a flexible cable 86 so that the internal cable 88 may be tied to a first half of the sliding plate 38'. In this way, movement of the eyebar 52 serves to draw the internal cable 88 through the sheath.

Figure 5:
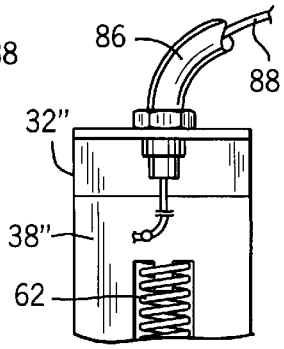
FIG. 5 is a fragmentary front elevational view of the first and second plates of FIGS. 2 and 3 as modified for use with a flexible cable.

Referring now to FIG. 5, a second half of the stationary plate 32" attached to the contactor (not shown in FIG. 5) may receive and hold the outer sheath of the flexible cable 86 and the internal cable 88 may be attached to a second half of the sliding plate 38" so that movement of the eyebar 54 serves to accomplish the same relative movement between the sliding plate 38" and stationary plate 32" as accomplished with the embodiment of FIG. 3 with the exception that the eyebar 54 may be flexibly located by virtue of the cable 86.

The above description has been that of a preferred embodiment of the present invention. It will occur to those that practice the art that many modifications may be made without departing from the spirit and scope of the invention. In order to apprise the public of the various embodiments that may fall within the scope of the invention, the following claims are made:

I claim:

1. In an electrical contactor of the type having a contactor coil having terminals to receive an activation current and a tab for movement along an actuation direction when the activation current is received by the terminals to activate the contactor, the improvement comprising:

a stationary plate fixed with respect to the coil and providing a jamb;

a sliding plate held by the stationary plate to slide along an axis with respect thereto, the axis being substantially perpendicular to the actuation direction of the armature;

a movable stop attached to the sliding plate and having a first position blocking movement of the tab and a second position permitting movement of the tab; and an eye bar attached to the movable stop and having at least one eye passing through the jamb with motion of the stop, the eye sized to receive a shackle of a padlock, the jamb preventing motion of the eye bar and stop when the shackle is so received.

2. The electrical contactor of claim 1 wherein the stop is positioned to be blocked from moving into the second position when the contactor is activated.

3. The electrical contactor of claim 1 including a cabinet having a door that may open and close and including an aperture;

wherein the eye bar is positioned to extend through the door when the door is closed;

the aperture being sized so that the door is held closed by interference between the aperture and a shackle of a padlock when the shackle is received in the eye.

4. The electrical contactor of claim 1 including a sensing contact pair attached to the movable stop to open when the movable stop is in the first position;

whereby the sensing contact pair may be wired in series with the coil to prevent current flow through the coil when the movable stop is in the first position.

5. The electrical contactor of claim 1 including a flexible cable connecting the eye bar to move with the movable stop.

6. The electrical contactor of claim 1 wherein the stationary plate has mounting holes receiving screw fasteners attaching the stationary plate to a housing holding the coil and the sliding plate communicates with the eye bar to move therewith and has access holes aligning with the mounting holes in the stationary plate when the stop is in the second position but not in the first position where the access holes do not permit access to the mounting holes.

7. The electrical contactor of claim 1 including in addition a spring biasing the movable stop to the first position.

8. The electrical contactor of claim 6 wherein the first plate forms the jamb and an extension of the second plate forms the eye bar.

* * * * *